US006131978A

United States Patent [19]

Rounds

[11] Patent Number: 6,131,978

[45] **Date of Patent: *Oct. 17, 2000**

[54] GRAPPLE FOR USE ON SKIDDER

[76] Inventor: Roy M Rounds, P.O. Box 704, Dawson Creek, BC, Canada, V1G 4H7

[ * ] Notice: This patent issued on a continued prosecution application filed under 37 CFR 1.53(d), and is subject to the twenty year patent term provisions of 35 U.S.C. 154(a)(2).

[21] Appl. No.: 09/029,847

[22] PCT Filed: Sep. 9, 1996

[86] PCT No.: PCT/CA96/00603

§ 371 Date: Mar. 9, 1998

§ 102(e) Date: Mar. 9, 1998

[87] PCT Pub. No.: WO97/12831

PCT Pub. Date: Apr. 10, 1997

[30] Foreign Application Priority Data

| | | | |
|---|---|---|---|
| Oct. 3, 1995 | [CA] | Canada | 2159743 |
| Jan. 9, 1996 | [CA] | Canada | 2166815 |

[51] Int. Cl.[7] ..... B66C 1/28

[52] U.S. Cl. ..... 294/106; 294/88; 294/902

[58] Field of Search ..... 294/3, 68.23, 88, 294/106, 107, 902; 414/739; 37/903

[56] References Cited

U.S. PATENT DOCUMENTS

| | | | |
|---|---|---|---|
| 1,346,160 | 7/1920 | Barlow | 294/88 |
| 2,740,210 | 4/1956 | Hamborg | 294/106 |
| 3,082,031 | 3/1963 | Lindberg | 414/739 |
| 3,904,232 | 9/1975 | Byles | 294/106 |
| 4,993,914 | 2/1991 | Riddle | 294/902 |

FOREIGN PATENT DOCUMENTS

| | | | |
|---|---|---|---|
| 934712 | 10/1973 | Canada . | |
| 1077087 | 5/1980 | Canada . | |
| 832480 | 7/1949 | Germany . | |
| 1105579 | 4/1961 | Germany | 294/106 |
| 25 37 007 | 2/1977 | Germany . | |
| 267861 | 5/1971 | U.S.S.R. | 294/88 |
| 1440849 | 11/1988 | U.S.S.R. | 294/106 |

*Primary Examiner*—Dean J. Kramer
*Attorney, Agent, or Firm*—Elbie R. de Kock

[57] ABSTRACT

A grapple prong comprising an elongate member terminating in a grapple prong and having a connecting formation thereon for connecting the tong head for pivotal movement about a pivotal axis. The tong is provided with a secondary prong thereon which is radially offset from the prong with respect to the pivotal axis. An attachment for converting a conventional grapple prong into a tong having two prongs is also provided.

3 Claims, 5 Drawing Sheets

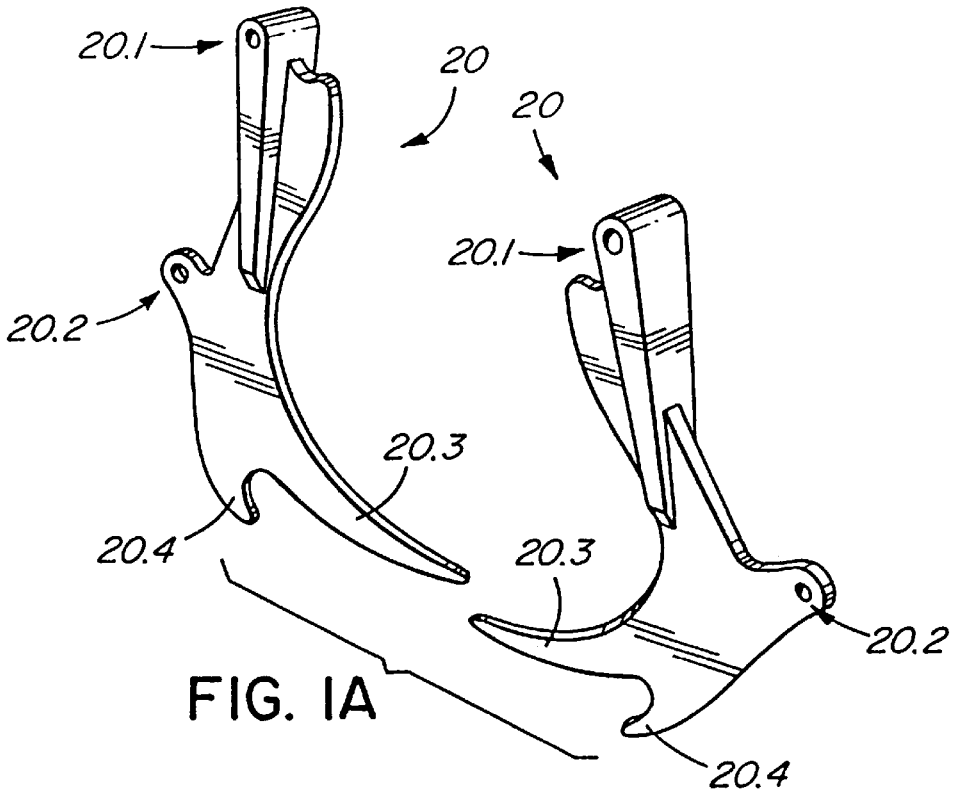
FIG. IA
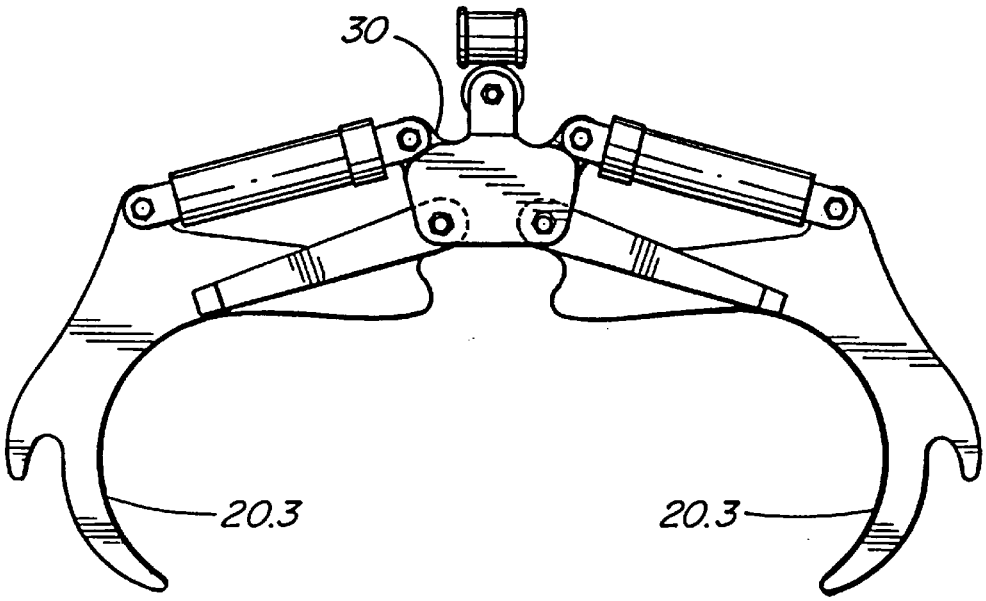
FIG. IB

GRAPPLE FOR USE ON SKIDDER

FIELD OF THE INVENTION

This invention relates to a grapple for a skidder used in the logging industry. In particular, it relates to a grapple tong and an attachment for a grapple tong.

BACKGROUND OF THE INVENTION

Skidders are used in the logging industry for transporting or sorting logs by pulling them along the ground. This is achieved by a grapple on the skidder which comprises a pair of opposed tongs which grips the log or logs for pulling along the ground. The tongs are pivotally mounted members which are hydraulically or cable operated for moving towards and away from one another in order to effect the gripping action. The grapple is located at the end of a boom which can be raised or lowered by hydraulic or cable means.

A grapple can be used to transport a bundle of logs in which case the grapple is used to clamp all the logs between the tongs, or it can be used in applications where single or smaller diameter logs are transported. A problem which arises in the latter type of application is that the tongs of some grapples do not come close enough together when closed in order to effectively grip a log. A further problem which arises is that grapples which are designed for gripping a bunch of logs, referred to as bunching grapples, have a relatively long opening and closing time making them very time consuming to open and close for a single log or broken tree.

It is accordingly an object of the present invention to alleviate the above difficulties.

SUMMARY OF THE INVENTION

According to the invention there is provided a grapple comprising a pair of opposed tongs which are movable toward or away from one another about respective pivotal axes, each tong terminating in a grapple prong for gripping objects between the grapple prongs, characterized in that each tong is provided with a secondary prong thereon, which secondary prong is radially offset from the grapple prong with respect to the pivotal axis.

Further according to the invention there is provided a grapple tong comprising an elongate member terminating in a grapple prong and having a connecting formation thereon for connecting the grapple tong to a grapple head for pivotal movement about a pivotal axis, characterized in that the tong is provided with a secondary prong thereon, which secondary prong is radially offset from the grapple prong with respect to the pivotal axis.

Also according to the invention there is provided an attachment for a grapple tong which grapple tong comprises an elongate member terminating in a grapple prong and having a connecting formation thereon for connecting the grapple tong to a grapple head for pivotal movement about a pivotal axis, characterized in that the attachment comprises a base provided with a projection thereon for attachment to the grapple tong along the base, whereby the projection forms a secondary tong on the grapple tong which is radially offset from the grapple prong with respect to the pivotal axis.

Other objects and advantages of the invention will become apparent from the description of a preferred embodiment of the invention below.

BRIEF DESCRIPTION OF THE DRAWINGS

The invention will now be described, by way of examples, with references to the accompanying drawings, in which:

FIG. 1A is a three-dimensional view of a pair of tongs according to the invention, shown in dissembled condition;

FIGS 1B to 1D, respectively, show side views of the tongs of FIG. 1A assembled in a grapple, with the tongs in a fully open position, a semi-closed position, for gripping a bundle of logs, and a closed position for gripping a single log;

DETAILED DESCRIPTION OF PREFERRED EMBODIMENT

Figure 1C:
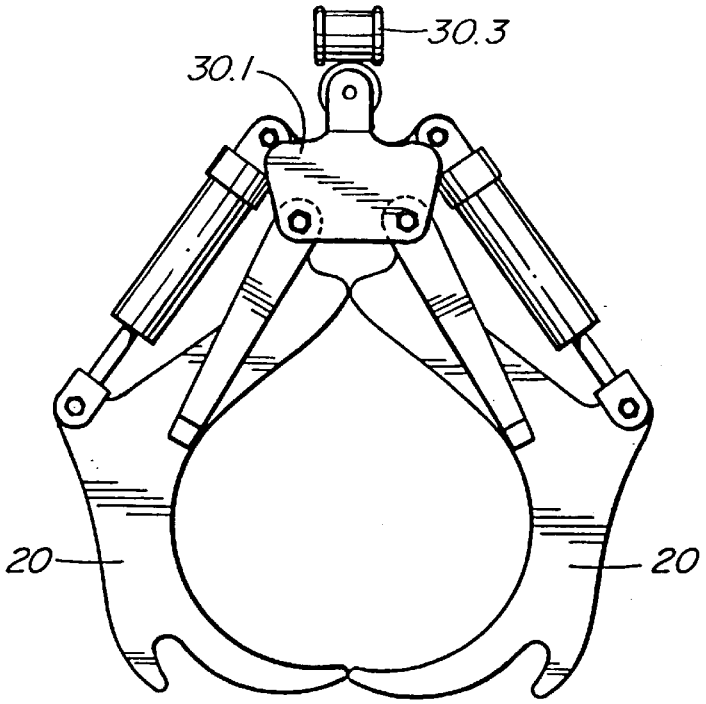
Figure 1D:
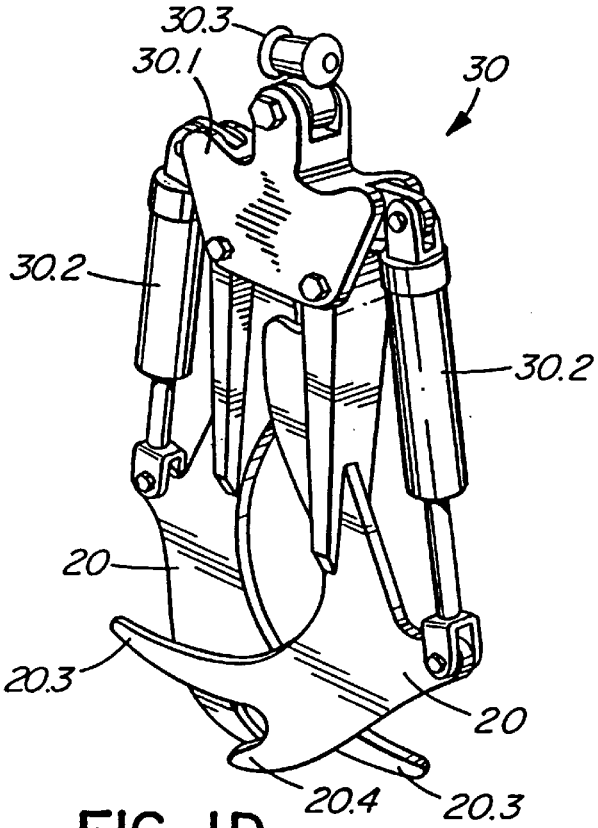

Referring to FIG. 1A, reference numeral 20 indicates a pair of tongs or tines which are adapted for assembly in opposed relationship in a grapple 30, as shown in FIGS 1B to 1D.

The grapple 30 comprises a head 30.1 to which the tongs 20 are pivotally connected through connection openings 20.1 at their upper ends. Each tong 20 is powered by a hydraulic cylinder 30.2 which is connected between the grapple head 30.1 and a connection opening 20.2 on the tong 20, for moving the tongs 20 towards and away from one another. In use, the grapple head 30.1 is pivotally connected, through a connection 30.3, to the boom of a skidder (not shown).

Each tong 20 comprises an elongate curved member with the connection opening 20.1 at its upper end and a prong 20.3 at its lower end. Each tong 20 is further provided with a projection or secondary prong 20.4 on its outer side.

As shown in FIG. 1D, the projections 20.4 are arranged to cooperate with one another when the tongs 20 are brought together in order to grip a single log between the projections 20.4.

In use, log bundles or larger diameter logs will be gripped between the upper curved parts of the tongs 20 in the usual manner, whereas single or smaller diameter logs can be gripped between the projections 20.4.

The purpose of the added projections or secondary prongs or tongs 20.4 is to speed up the handling of stray or single logs, which is especially useful in bunching grapples that are time consuming to open and close for one log or broken tree.

The skidder engine will not have to be operated at full revolutions to provide the hydraulics with speed because the tongs 20 will only need to be opened a small distance.

Figure 2:
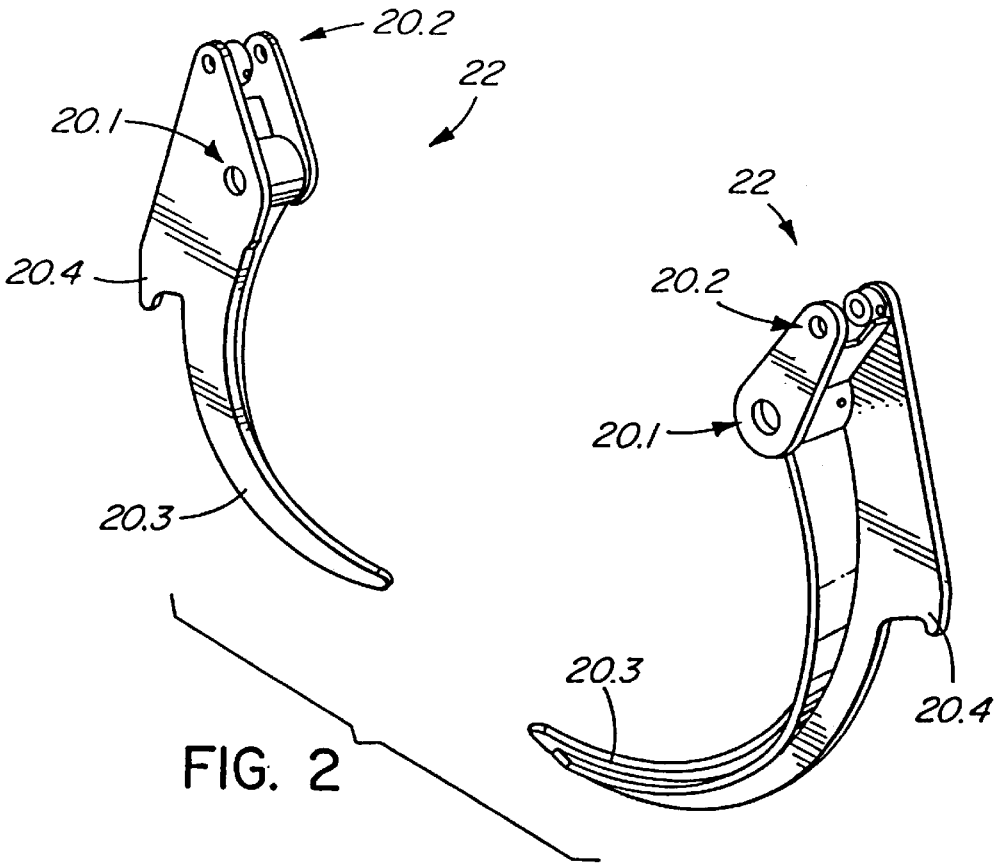
FIG. 2 is a three-dimensional view of a pair of tongs according to another embodiment of the invention, shown in dissembled condition.

The projections 20.4 can be provided on different designs of logging grapple tongs, to replace the conventional single prong tongs currently in use on the various types of grapples which are available. The tongs 20 shown in FIG. 1A are examples of tongs which are of cast iron. In FIG. 2 tongs 22 are shown which are of welded frame construction. The parts of the tongs 22 which correspond with the parts of the tongs 20 are given like reference numerals.

On the cast tongs 20 shown in FIG. 1A, the secondary tongs 20.4 also increases the strength of the tong 20 at the point of stress where breakage tends to occur.

It will be apparent that the projections 20.4 can be provided in various sizes to suit various grapple sizes, yet preferably arranged to overlap to close to a three inch opening having a cats eye shape.

Figure 3:
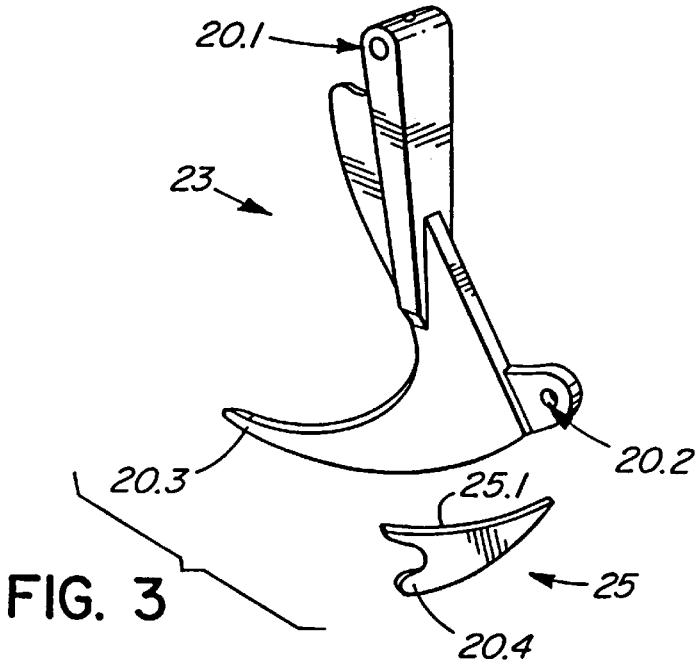
FIG. 3 is a three-dimensional view showing a conventional grapple tong and a tong attachment according to the invention.

It is also possible to convert a conventional grapple tong 23 having a single prong 20.3, into a tong with a secondary prong by providing a tong attachment 25, as shown in FIG. 3.

As can be seen from FIG. 3, the tong attachment 25 has a base 25.1 and a projection 20.4 extending therefrom. The attachment 25 is welded to the lower part of the tong 23 along the base 25.1 so that the projection 20.4 projects from the lower part of the tong 23 to form a secondary prong 20.4, thereon.

The tong attachments 25 on the prongs 23 are arranged so that the projections 20.4 overlap to a three inch cats eye configuration when the tongs 23 are in the closed position in a grapple.

The purpose of the tong attachments 25 is to better equip the grapple 30 to handle with speed the sorting of stray and broken logs. This is especially useful with bunching grapples which are time consuming to open and close for one log. With the attachment 25 fitted, the grapple 30 only needs to open a small distance to receive the log and by being able to close to a three inch hole, it provides for much better waste management in the forest.

The tong attachments 25 providing the projections or secondary tongs 20.4 on the opposed tongs 23 in practise act as a pair of tweezers to grapple logs too small to be grappled by existing tongs.

Figure 4A:
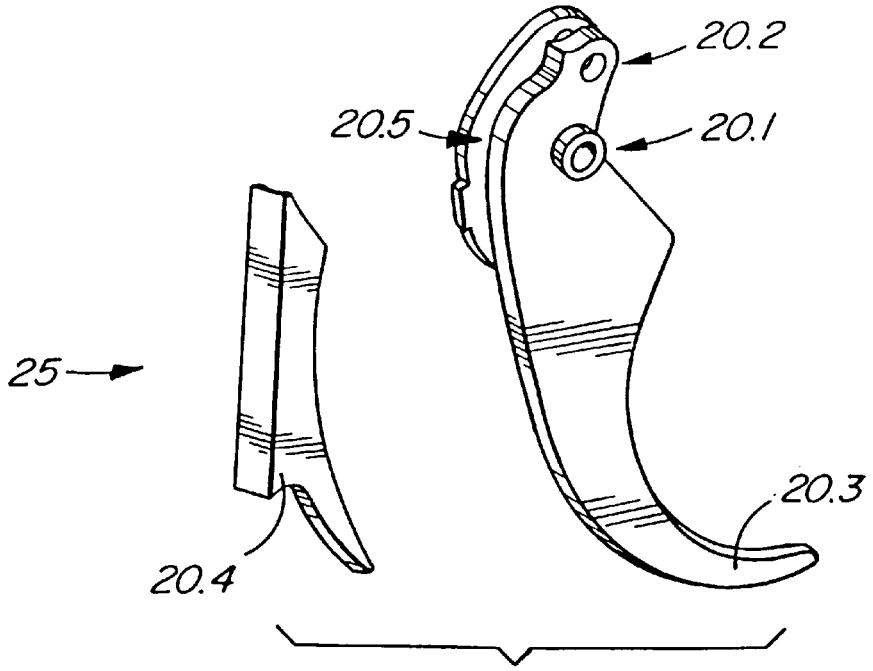
FIG. 4A is a three-dimensional view showing a conventional grapple tong and a tong attachment according to another embodiment of the invention.
Figure 5:
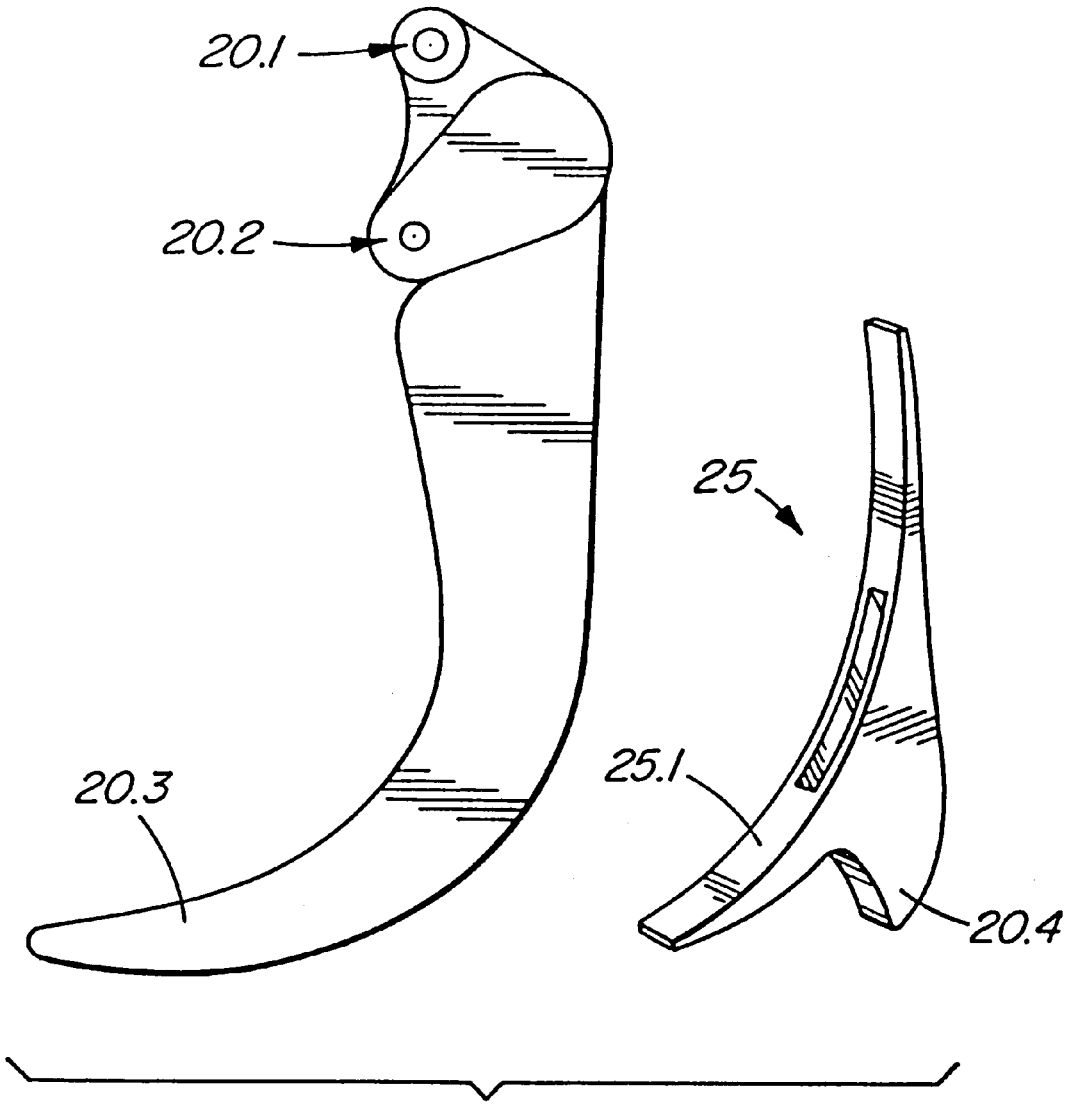
FIG. 5 shows a conventional tong, in side view, and a three-dimensional view of a tong attachment according to another embodiment of the invention.

The tong attachment 25 can be provided for various different designs of conventional tongs, as shown in FIGS. 4A and B and FIG. 5, where parts corresponding with those in FIG. 3 have been given like reference numerals.

Figure 4B:
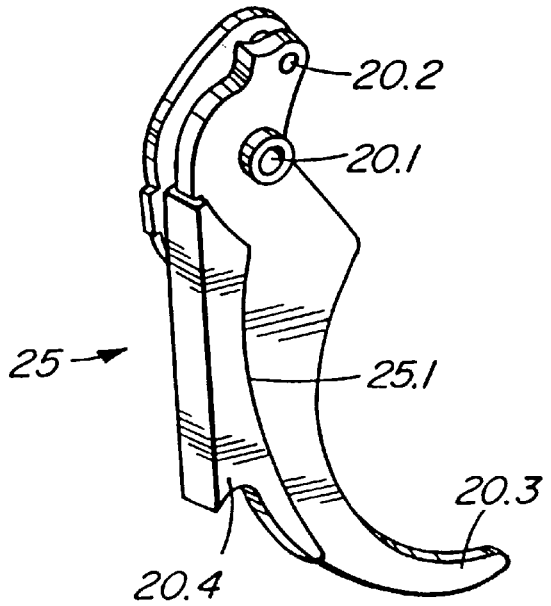
FIG. 4B shows the tong of FIG. 4A with the tong attachment according to the invention attached thereto.

In the embodiment shown in FIGS. 4A and 4B, the tong is first provided with a cut-out, as shown at 20.5, before welding the attachment 25 into place.

While only preferred embodiments of the invention have been described herein in detail, the invention is not limited thereby and modifications can be made within the scope of the attached claims.

What is claimed is:

1. A grapple capable of gripping logs for use in the logging industry, comprising:

a pair of opposed tongs which are movable about respective pivotal axes, away from one another or toward one another to overlap at a point on the respective pivotal arcs of the tongs diametrically below their respective pivotal axes, each tong terminating in a pointed primary grapple prong;

each tong having a pair of opposite sides which are curved inwardly in the same direction, which tong together with the opposed tong defines a primary convex gripping area for gripping objects therebetween, when the opposed tongs of the grapple are moved toward one another;

each tong being provided with a secondary grapple prong fixedly and non-removably attached to the tong for movement in unison therewith;

each secondary grapple prong being radially more remote from the pivotal axis than the primary grapple prong and being in a plane which is substantially perpendicular to the pivotal axis;

each secondary grapple prong further having a pair of opposite sides which are curved inwardly so that the secondary grapple prongs of the opposed tongs define a secondary convex gripping area of smaller dimension than the said primary convex gripping area for gripping objects there between when the opposed tongs of the grapple are moved together to overlap; and each secondary grapple prong being shorter than the primary grapple prong.

2. An attachment for a grapple tong which grapple tong is capable of gripping logs and comprises an elongate member terminating in a grapple prong and having a connecting formation thereon for connecting the grapple tong to a grapple head for pivotal movement about a pivotal axis, characterized in that the attachment comprises a base provided with a projection thereon for attachment to the grapple tong along the base to fixedly locate the attachment thereon, whereby the projection forms a secondary tong on the grapple tong which is radially more remote from the pivotal axis than the grapple prong, which secondary tong is also capable of gripping a log.

3. A grapple tong which is capable of gripping logs and comprises an elongate member terminating in a grapple prong and having a connecting formation thereon for connecting the grapple tong to a grapple head for pivotal movement about a pivotal axis, and including an attachment which comprises a base provided with a projection thereon which is attached to the grapple tong along the base to fixedly locate the attachment thereon, whereby the projection forms a secondary tong on the grapple tong which is radially more remote from the pivotal axis than the grapple tong.

* * * * *